US006075218A

United States Patent [19]

Trautmann et al.

[11] Patent Number: 6,075,218

[45] Date of Patent: Jun. 13, 2000

[54] LOAD-BREAK SWITCH

[75] Inventors: Günter Trautmann, Schwarzenbruck; Jörg Ullrich Peterreins, Schwabach, both of Germany

[73] Assignee: Peterreins Schalttechnik GmbH, Schwabach, Germany

[21] Appl. No.: 09/167,356

[22] Filed: Oct. 7, 1998

[30] Foreign Application Priority Data

Oct. 9, 1997 [DD] German Dem. Rep. ..... 197 44 563

[51] Int. Cl.[7] ..... H01H 3/00; H01H 3/24

[52] U.S. Cl. ..... 218/154; 335/185; 335/190

[58] Field of Search ..... 335/167–176, 335/185–190; 218/154, 78, 84, 152, 153; 200/400, 401

[56] References Cited

U.S. PATENT DOCUMENTS 3,563,102 2/1971 Bernatt et al. ..... 200/401

4,778,959 10/1988 Sabatella et al. ..... 218/22

5,486,668 1/1996 Erickson ..... 200/400

5,504,293 4/1996 Rogers et al. ..... 218/154

*Primary Examiner*—Lincoln Donovan

*Assistant Examiner*—Tuyen T. Nguyen

*Attorney, Agent, or Firm*—Friedrich Kueffner

[57] ABSTRACT

A load-break switch or load disconnecting switch with a spring-type over-center device whose axis actuates a switching means drive, preferably a switching shaft, includes a lever actuated by a magnet, wherein the magnet moves the lever along a path of movement, wherein the lever moved along this path of movement initially causes an uncoupling of the over-center device axis from the switching means drive and during the further travel along the path of movement the lever actuates the switching means drive which results in an "off" position of the load-break switch, and the lever subsequently again effects a coupling between the over-center device axis and the switching means drive.

11 Claims, 5 Drawing Sheets

LOAD-BREAK SWITCH

BACKGROUND OF THE INVENTION

1. Field of the Invention

The present invention relates to a load-break switch or load disconnecting switch with a spring-type over-center device whose axis actuates a switching means drive, preferably a switching shaft.

2. Description of the Related Art

A load-break switch of this type is disclosed, for example, in DE 43 05 746 C2. This switch makes possible a satisfactory switching on and switching off required during operation. However, in an emergency situation, there may be the requirement for an immediate switching off. Such an emergency may be, for example, the failure of a fuse, the occurrence of different phase sequences or other problems. Arrangements in power switches have been provided for this purpose, however, these arrangements all have the disadvantage that they are very complicated and, thus, expensive to manufacture, and that they require a large amount of space.

SUMMARY OF THE INVENTION

Therefore, it is the primary object of the present invention, in a load-break switch of the above-described type, to provide simple and simultaneously safe means for immediately switching off the load-break switch when an emergency or a problem occurs.

In accordance with the present invention, the load-break switch includes a lever actuated by a magnet, wherein the magnet moves the lever along a path of movement, wherein the lever moved along this path of movement initially causes an uncoupling of the over-center device axis from the switching means drive and during the further travel along the path of movement the lever actuates the switching means drive which results in an "off" position of the load-break switch, and the lever subsequently again effects a coupling between the over-center device axis and the switching means drive.

The solution according to the present invention provides a switch which switches off with relatively few and simple means and, thus, is not of complicated construction and requires little space. This will also be apparent from the description below of embodiments of the invention. Accordingly, the switch according to the present invention is not complicated as is the case in conventional power switches. For preventing the consequences of a short circuit it is sufficient if appropriate fuses are connected in front of the load-break switch constructed according to the present invention.

The actuation of the magnet, which takes place as a result of one of the problems described above, operates extremely quickly and releases a two-stage sequence of movement, wherein an unlocking or uncoupling between the over-center device axis and the switching means drive takes place during a first phase, while the switching means drive is actuated in the subsequent second phase in such a way that the load-break switch assumes the required "off" position. This eliminates the danger of damage to the load-break switch as well as to the electric units, devices, etc. which are supplied with electric power (current and voltage) through this load-break switch. It is important in this connection that during the entire two-stage release procedure described above no manual manipulations or preparations are required which, as experience has shown, may be forgotten and which also require a certain amount of time. The load-break switch initially remains in this "off" position until it is clear that the respective problem or the like has been eliminated. The magnet is subsequently switched off and moved into the "off" position, so that the lever also return into its initial position. The load-break switch can now again be switched on normally by hand.

It is additionally of importance that the magnet of this load-break switch does not have to have such a power that the spring-type over-center device of the load-break switch would have to be overcome mechanically; this is because the spring-type over-center device is not required in the first phase nor in the second phase. Rather, for carrying out the second phase, a relatively low strength of the magnet is also sufficient for carrying out the second phase during which it moves the lever and causes the above-described unlocking or uncoupling actions, as well as the aforementioned switching procedure, preferably by rotating a switching shaft.

The present invention can preferably be used in load-break switches whose spring-type over-center device operates independently of the direction of rotation, i.e. a so-called star wheel over-center device. The present invention can be used with particular advantage in a load-break switch arrangement according to DE 43 05 746 C2 mentioned above. However, the invention is not limited to this use. Rather, the invention can also be used in principle in other switch constructions.

In accordance with a preferred embodiment of the invention, a locking bolt is provided which can assume two positions, i.e., a coupling position between the over-center device axis and the switching means drive or an uncoupling position in which the drive connection between the over-center device axis and the switching means drive is interrupted. This locking bolt is located in its coupling position in the path of movement of the lever and the locking bolt and the lever are constructed in such a way that the movement of the lever displaces the locking bolt out of the coupling position into the uncoupling position. This provides the possibility of a simple uncoupling by displacing or shifting a locking bolt which acts quickly and is very simple and safe with respect to the structural configuration of the locking bolt itself and the over-center device axis and switching means drive to be coupled and uncoupled by the locking bolt.

In accordance with another advantageous feature, an abutment is fastened to the coupling portion of the switching means drive. This abutment is also located in the path of movement of the lever and the distance and position of this abutment from a counter-abutment of the lever is such that when the lever is displaced its counter-abutment comes into contact with the abutment of the switching means drives only after uncoupling of the locking bolt and displaces, preferably pivots, this switching means drives into the "off" position. Consequently, when the lever is moved further it moves an abutment on the switching means drive in such a way that it carries out the second phase, i.e., the switching contacts of the load-break switch are moved into the "off" position. This also does not require manual manipulations. This is an advantage which not only reduces the work load of the operating personnel, but is especially important to protect against any inattention of the personnel. After the two-stage switching phase has ended, the locking bolt returns into the locking position, so that the spring-type over-center device and the switching shaft are once again coupled to each other.

Finally, in accordance with another feature of the present invention, the magnet is switched off when the problem has been eliminated and the lever is under the influence of a restoring spring which returns the lever into its initial position after the magnet has been switched off. Consequently, no manual manipulations are required after the problem has been eliminated by switching off the magnet and returning the lever in its initial position. The load-break switch can then again be switched manually, wherein the first actuation eliminates the previously required "off" position and the load-break switch is placed into the "on" position.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
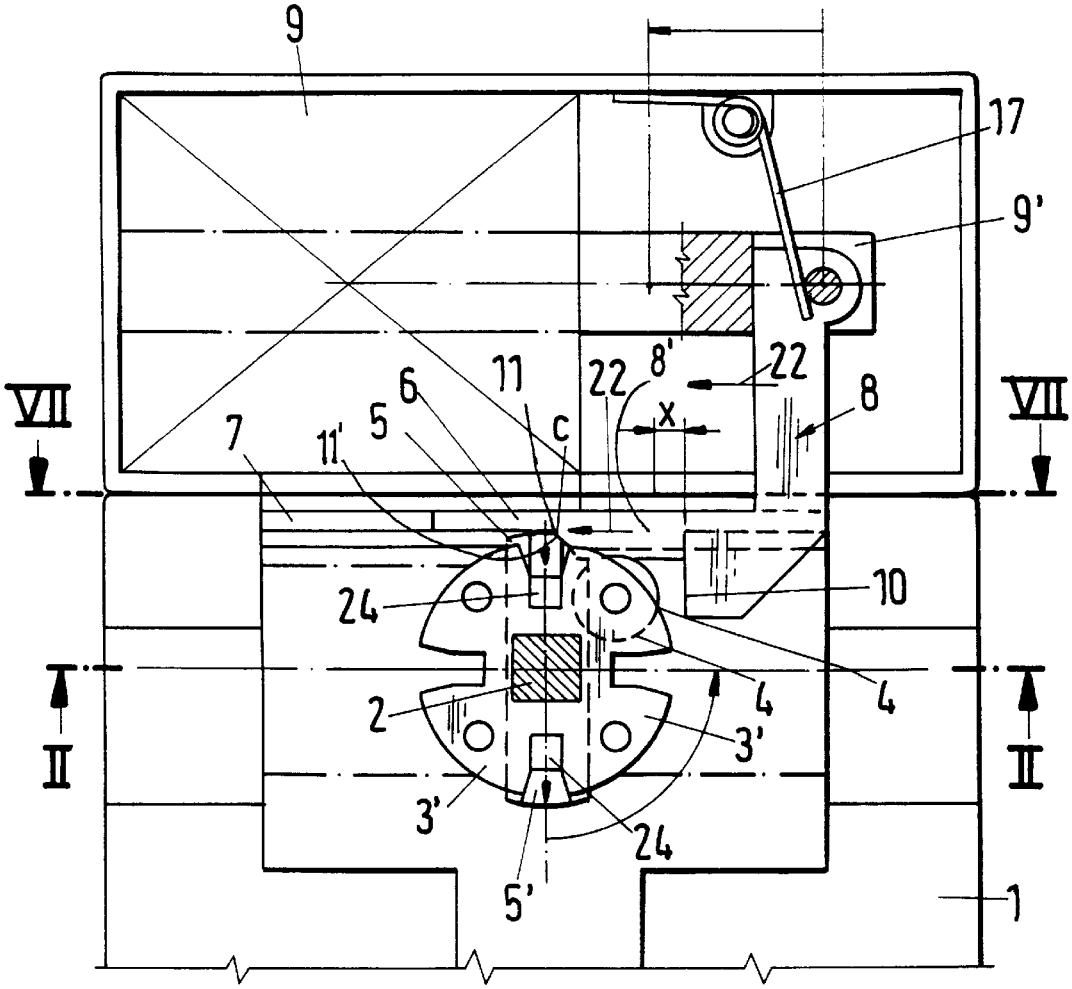
FIG. 1 is a top view of a control arrangement and a portion of a bottom part of the housing of a load-break switch.

FIG. 1 of the drawing shows the lower part 1 of the housing of a load-break switch which includes a magnet 9 schematically illustrated at the top or FIG. 1, wherein the magnet 9 is switched on in the case of a problem through supply lines and controls which are not illustrated.

When the magnet is switched on, its armature 9' moves against the action of the spring 17 into the interior of the magnet and causes a lever 8 to be moved, wherein the lever 8 has the function of a switching lever or a plunger and, thus, is moved in the direction of arrow 22. The lever 8 is guided with a relatively narrow guide part 6 in a guide slot 7 of the housing, wherein the guide slot 7 extends in the direction of the path of movement to be explained below. As illustrated in FIG. 1, an angle portion 8' of the lever 8 is moved in this direction toward the left, After travelling the length x in this path of movement as indicated by arrow 22, a contact surface 11 of the lever portion 8' extending obliquely relative to this path of movement comes into contact with a countersurface 11' of a locking bolt 5 extending parallel to the contact surface 11 and moves the lever 5 in the direction of arrow 23, as shown in FIG. 3.

Figure 3:
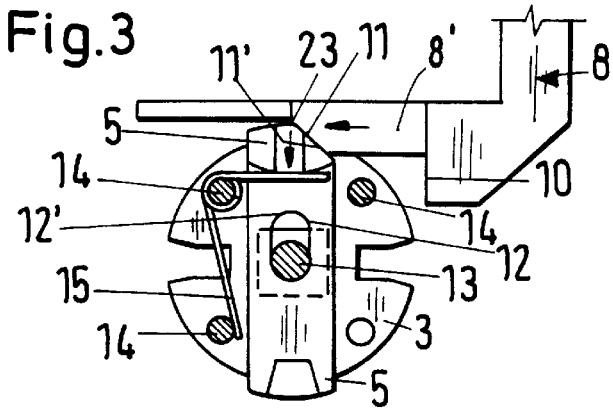
FIG. 3 is a sectional view taken along sectional line III—III of FIG. 2.
Figure 2:
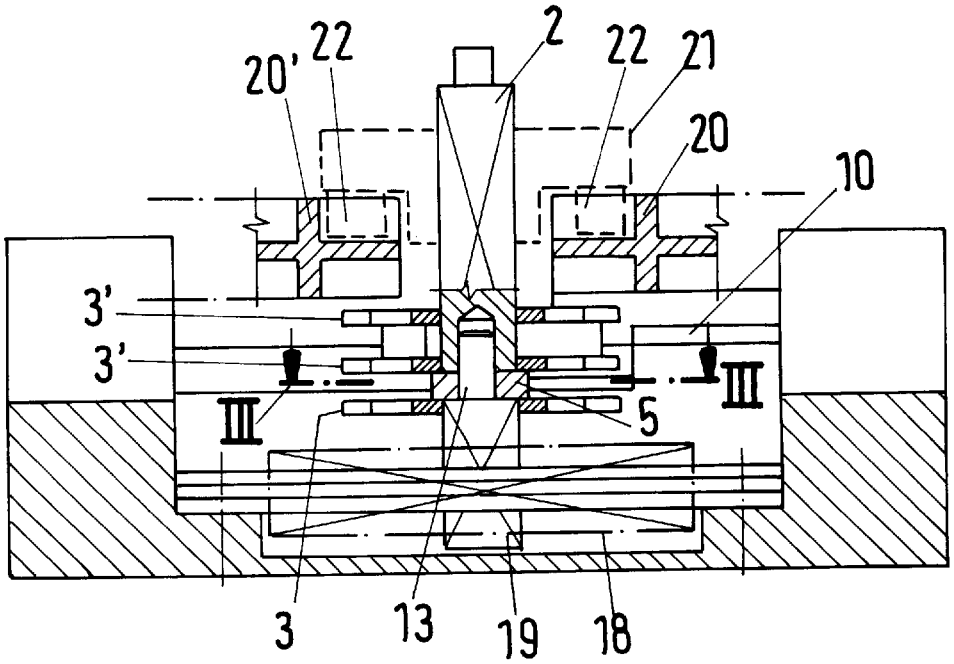
FIG. 2 is a sectional view taken along sectional line II—II of FIG. 1, including a sectional view of the components of the switch located above the area illustrated in FIG. 1.

As also shown in FIG. 3, the two end positions of the locking bolt 5 including its portion 5' located on the opposite side are limited by a slot 12 in the locking bolt and a contact pin 13. In the position shown in FIG. 3, the locking bolt 5 is in the locking or coupling position which shall be described in more detail below. After moving the locking bolt in the direction of arrow 23, the upper end 12' of the slot 12 comes into contact with the contact pin 13 which is mounted on the upper end face of the over-center device axis 19. This pin 13 simultaneously serves to center the switching shaft 2 by engaging the lower end thereof, as shown in FIG. 2. consequently, the locking bolt 5, 5' assumes the position illustrated in FIG. 4; this is done by overcoming the force of the spring 15 which has the tendency of pressing the locking bolt 5, 5' into the locking or coupling position shown in FIGS. 1 and 3.

Figure 7:
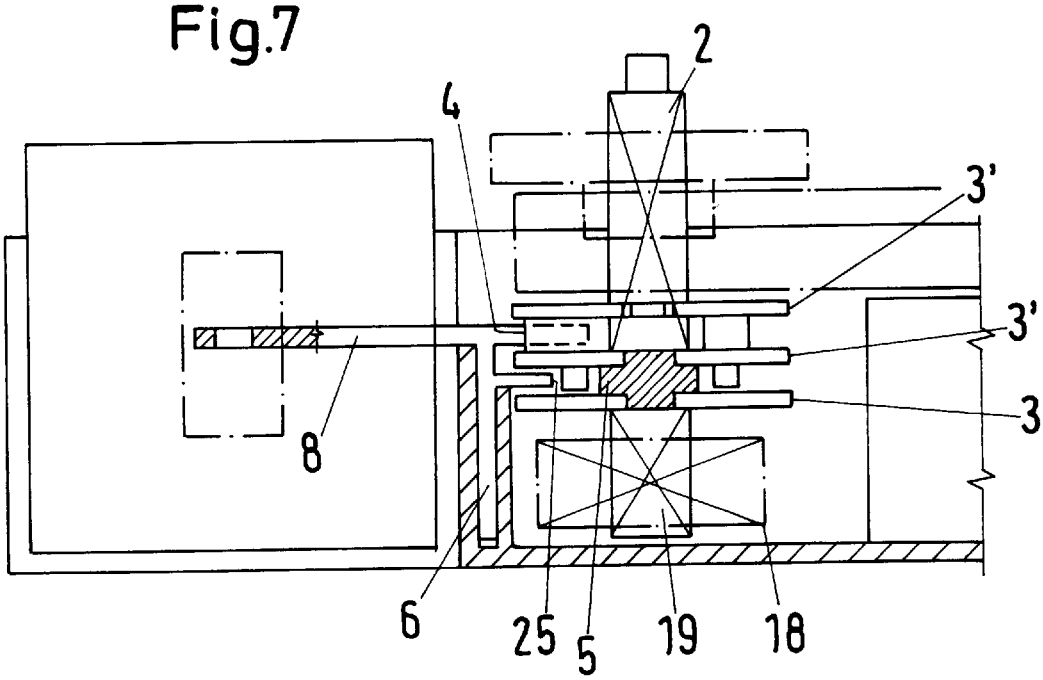
FIG. 7 is a sectional view taken along sectional line VII—VII of FIG. 1 without intermediate walls.
Figure 4:
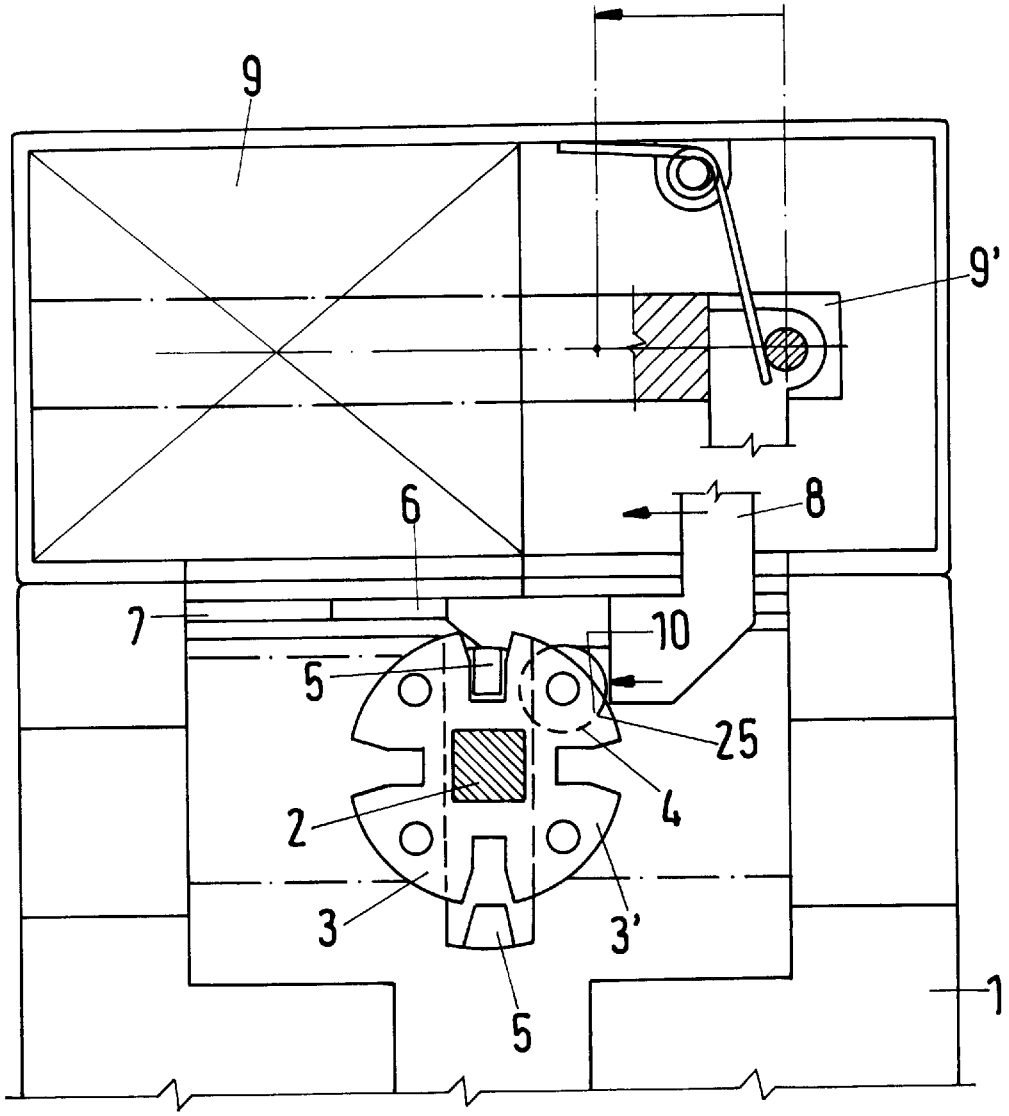
FIG. 4 is a view similar to FIG. 1, but shown after the actuation of the magnet and displacement of the locking bolt into the uncoupled position (first switching stage)

When the locking bolt is moved into the position shown in FIG. 4, the quick-break switching mechanism and the switching drive are uncoupled from each other. In this connection, FIGS. 2, 6, and 7 show the configuration of the load-break switch in the vertical direction and particularly the coupling and uncoupling of the switching drive using a switching shaft 2 with and from the spring-type over-center device 18.

Figure 6:
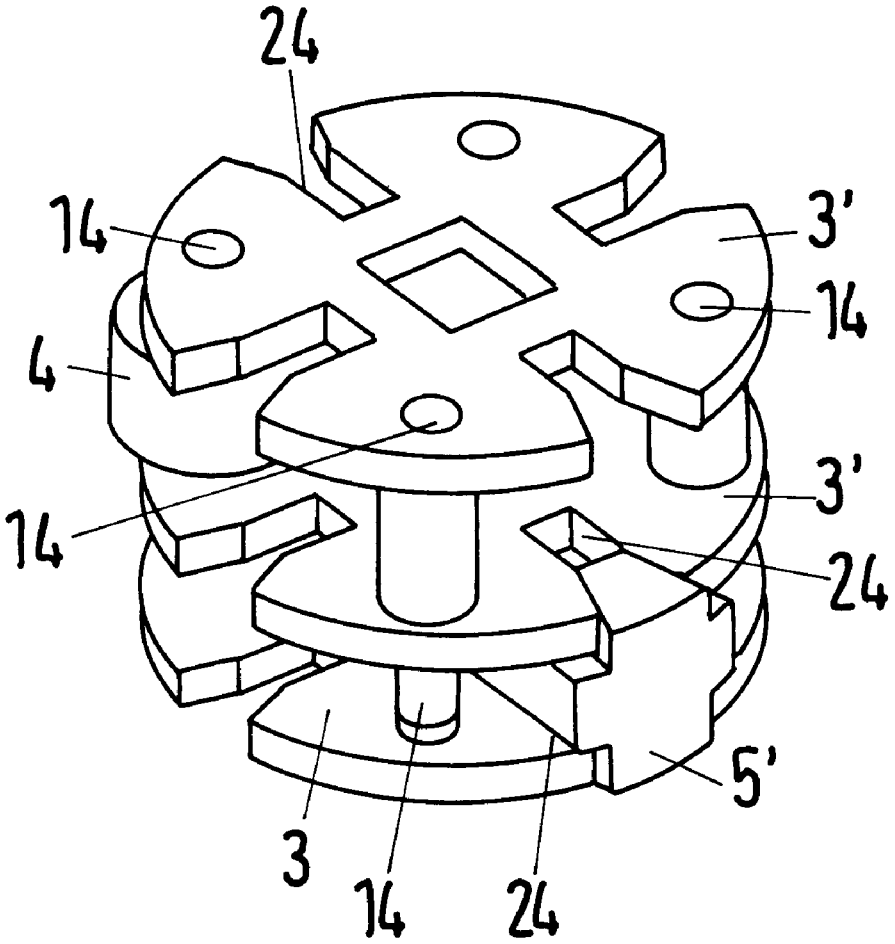
FIG. 6 is a perspective view of the coupling disks with locking bolt and abutments.

As particularly illustrated in FIG. 6, provided for this purpose is a coupling part which is composed of several coupling disks; in the illustrated embodiment, three coupling disks are provided, The over-center device axis 19 is rigidly connected to the lower coupling disk 3. Located thereabove are two coupling disks 3' which are rigidly connected to the drive shaft 2. The locking bolt 5, 5' already described above engages in segment recesses 24 of the lower coupling disk 3 and in corresponding, preferably trapezoidally-shaped, segment recesses 24 at least in the middle coupling disk 3', but possibly also in both coupling 3' of the drive shaft. This produces coupling and relative locking of the spring-type over-center device 18 and its axis 19 with the drive shaft 2 of the switching means. As described above, this coupling or locking is released in the first stage or phase of this automatic switching by contact of the surfaces 11, 11' (see FIG. 3) and an appropriate further movement of the lever 8 in the direction of arrow 22 moves the locking bolt 5, 5' into the position shown in FIG. 4. In this position, an abutment surface 25 of a switching projection 10 of the lever 8 rests against a switching roller 4 which is fastened between the two upper coupling disks 3' of the switching shaft 2; preferably, the switching roller 4 is rotatable about its axis.

It should be mentioned at this point that the two coupling disks 3' which are rigidly connected to the switching shaft 2 are rigidly connected to each other by means of bolts 14, as shown in FIG. 6. The lower coupling disk 3 which can be seen in FIG. 6 is not connected to the bolts 14. Rather, as also seen in FIG. 6, the bolts 14 end a short distance above the coupling disk 3. This makes it possible that the ends of the bolts 14 projecting toward the disk 3 can receive the restoring spring 15 for the locking bolt or may serve as a contact for one of the spring arms, as shown in FIG. 3.

Figure 5:
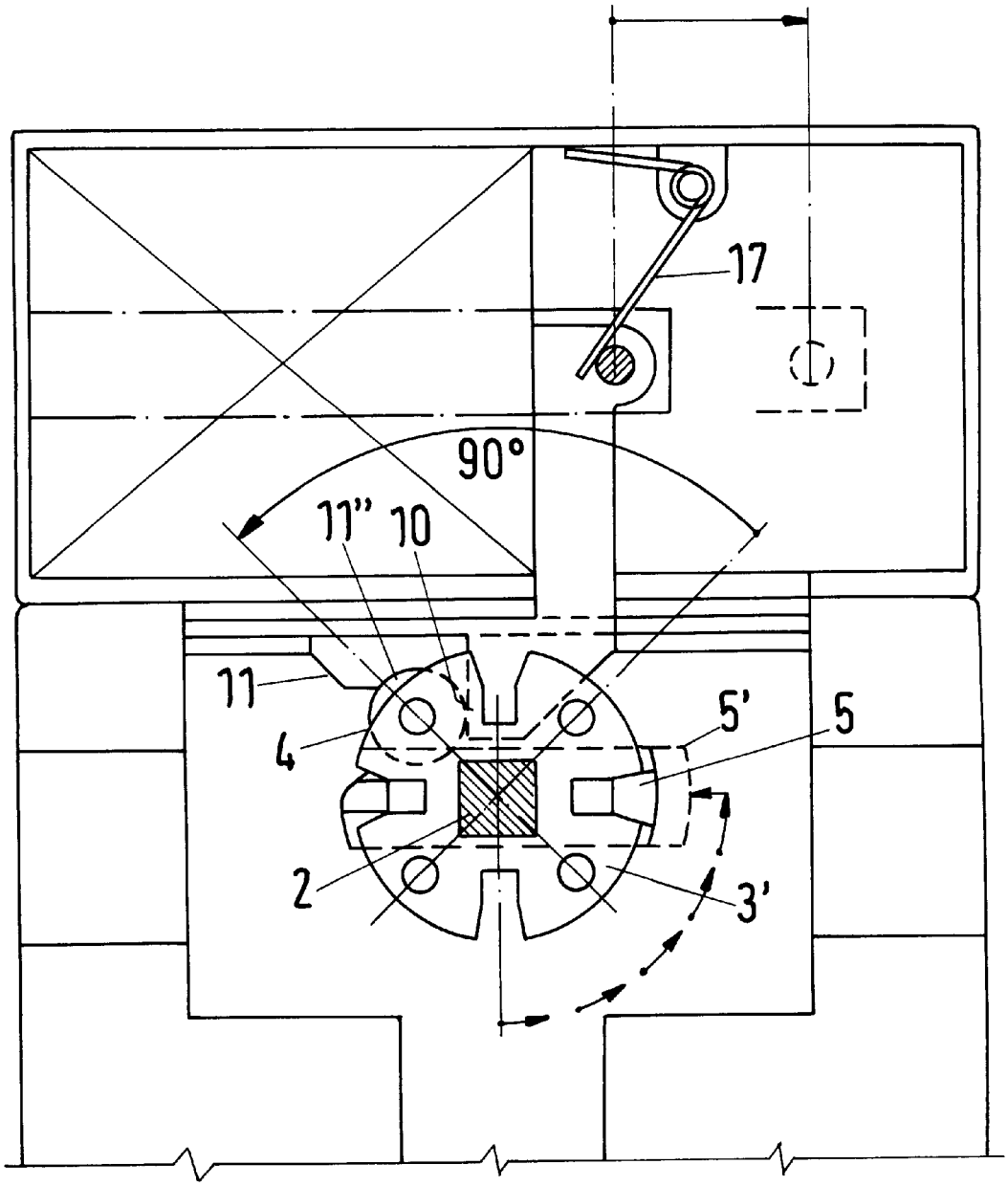
FIG. 5 is a view similar to FIGS. 1 and 4, but shown after turning of the coupling disk or coupling disks which are part of the switching drive into the "off" position.

After the locking bolt 5, 5' has been moved into the unlocked or uncoupled position according to FIG. 4, the contact surface 11' has been moved out of the range of movement of the contact surface 11 of the lever 8 and the pulling force of the magnet can move the lever 8 further in the direction of arrow 22. Since at the beginning of this movement the abutment surface 22 has already been in contact with the switching roller 4, the abutment surface 25 presses against the switching roller 4 and pivots the switching roller 4 and, thus, the coupling 3' of the switching shaft 2 into the position according to FIG. 5; in the illustrated example, pivoting about 90° takes place. This constitutes the second stage or phase of the automatic switching procedure. Simultaneously, in this position, the spring 15 pushes the locking bolt 5, 5' once again into the locking or coupling position.

As illustrated in FIG. 2, a switching ledge drive disk 21 is rigidly connect to the switching shaft 2. The disk 21 engages with drive members 22 in recesses of switching ledges 20, 20' of the load-break switch. The configuration is such that the rotation of the switching shaft described above into the position of FIG. 5 moves the switching ledges 20, 20' into the "off" position of the load-break switch. They remain in this "off" position until the magnet 9 is switched off when the problem has been eliminated and, under the influence of the restoring spring 17, again assumes the initial position shown in FIG. 1 together with the lever 8. It is then possible that the load-break switch can be manually moved into the switching position "on". This results in a return pivoting of the roller 4 and, thus, of the coupling disk arrangement 3, 3' into the initial position illustrated in FIG. 1. The load-break switch is then again available for normal switching operation. The spring 15 mentioned above is held by one of the bolts 14 which is elongated appropriately and rests against another bolt 14 which is also elongated.

During normal switching operations, switching on and off is effected in the conventional manner by means of a spring-type over-center device, preferably a star wheel spring-type over-center device which operates independently of the direction of rotation. In contrast to this manual manipulation during normal operation, the present invention provides an automatic coupling and uncoupling and an also automatic switching off of the load-break switch in the case of problems.

Short-circuit fuses may be connected in front of the load-break switch according to the present invention.

While specific embodiments of the invention have been shown and described in detail to illustrate the inventive principles, it will be understood that the invention may be embodied otherwise without departing from such principles.

We claim:

1. A load-break switch with a spring-type over-center device having an over-center device axis, and a switching means drive actuated by the spring-type over-center device, the load-break switch comprising a magnet and a lever, the magnet being adapted to actuate the lever so as to move the lever along a path of movement, wherein, when the lever is initially moved along the path of movement, the lever effects a functional decoupling of the over-center device axis and the switching means drive with respect to one another, and when moved further along the path of movement, the lever actuates the switching means drive to switch the load-break switch into an "off" position, and when moved still further along the path of movement, the lever effects a recoupling between the over-center device axis and the switching means drive.

2. The load-break switch according to claim 1, further comprising a locking bolt movable between a coupling position in which the over-center device axis and switching means drive are coupled and an uncoupling position in which a drive connection between the over-center device axis and the switching means drive is interrupted, wherein the locking bolt is in the coupling position thereof located in the path of movement of the lever, and wherein the locking bolt and the lever are configured such that the movement of the lever displaces the locking bolt from the coupling position into the uncoupling position.

3. The load-break switch according to claim 2, wherein the locking bolt and the lever each have a sliding surface arranged obliquely relative to the path of movement, wherein the sliding surfaces of the locking bolt and the lever extend parallel to each other and wherein the sliding surfaces of the locking bolt and lever interact with each other when the lever is moved in the path of movement and acts to uncouple the locking bolt.

4. The load-break switch according to claim 2, wherein the over-center device axis and the switching means drive each have coupling members provided with recesses, wherein the locking bolt is movable into and out of the recesses, such that when the locking bolt is inserted into the recesses, the coupling member of the over-center device axis is coupled to the coupling member of the switching means drive for rotation therewith, while when the locking bolt is moved out of the recesses the coupling members are uncoupled from each other and the over-center drive axis and the switching means drive are rotatable relative to each other.

5. The load-break switch according to claim 4, wherein the coupling member of the switching means drive comprises an abutment located in the path of movement of the lever, wherein the lever has a counter-abutment, wherein the abutment and the counter-abutment are distanced and positioned relative to each other such that when the lever is moved the counter-abutment thereof comes into contact with the abutment of the switching means drive only after the locking bolt has been uncoupled and the switching means drive is rotated into the "off" position.

6. The load-break switch according to claim 5, further comprising a switching spring for biasing the locking bolt into the coupling position after the abutment has reached an end position.

7. The load-break switch according to claim 5, wherein the abutment of the switching means drive is a switching roller mounted eccentrically of the over-center drive axis and the counter-abutment is a stop member of the lever.

8. The load-break switch according to claim 1, further comprising means for switching off the magnet after a problem has been eliminated, and a restoring spring acting on the lever for moving the lever back into the initial position thereof after the magnet has been switched off.

9. The load-break switch according to claim 1, wherein the over-center device axis has a stop pin, wherein the locking bolt has a slot for receiving the stop pin.

10. The load-break switch according to claim 1, wherein the over-center device is switchable in both directions of rotation.

11. The load-break switch according to claim 1, further comprising a short circuit fuse connected in front of the load-break switch.

* * * * *